US006991659B2

(12) United States Patent
Kittmer et al.

(10) Patent No.: US 6,991,659 B2
(45) Date of Patent: Jan. 31, 2006

(54) PRODUCTION OF TANNED LEATHER AND PRODUCTS SUITABLE THEREFORE

(75) Inventors: Roy Kittmer, Brandesburton (GB); Song Ma, Beverley (GB); Matthew Walker, Nafferton (GB)

(73) Assignee: Clariant Finance (BVI) Limited, Tortola (VG)

( * ) Notice: Subject to any disclaimer, the term of this patent is extended or adjusted under 35 U.S.C. 154(b) by 33 days.

(21) Appl. No.: 10/470,077

(22) PCT Filed: Jan. 25, 2002

(86) PCT No.: PCT/IB02/00231

§ 371 (c)(1),
(2), (4) Date: Jul. 24, 2003

(87) PCT Pub. No.: WO02/059382

PCT Pub. Date: Aug. 1, 2002

(65) Prior Publication Data

US 2004/0074009 A1 Apr. 22, 2004

(30) Foreign Application Priority Data

Jan. 26, 2001 (GB) ..... 0102054

(51) Int. Cl.
*C14C 3/20* (2006.01)
*C14C 3/28* (2006.01)

(52) U.S. Cl. ..... 8/94.24; 8/94.33; 8/94.19 R

(58) Field of Classification Search ..... 8/436, 8/94.19 R, 94.24, 94.33
See application file for complete search history.

(56) References Cited

U.S. PATENT DOCUMENTS

| | | | |
|---|---|---|---|
| 5,256,317 A | 10/1993 | Lauton | 252/8.57 |
| 5,326,805 A | 7/1994 | Sicken et al. | 524/101 |

FOREIGN PATENT DOCUMENTS

| | | |
|---|---|---|
| EP | 0 428 481 | 5/1991 |
| EP | 0 526 815 | 2/1993 |
| GB | 353878 | 7/1931 |
| GB | 565675 | 11/1944 |
| GB | 745000 | * 2/1956 |

OTHER PUBLICATIONS

English abstract for EP 0526815, Feb. 10, 1993.
XP-002195002, English abstract for JP 2000217944, Aug. 8, 2000.

* cited by examiner

*Primary Examiner*—Margaret Einsmann
(74) *Attorney, Agent, or Firm*—Tod A. Waldrop

(57) ABSTRACT

The invention provides a process for the production of tanned and optionally retanned leather by treatment of an optionally (pre)tanned animal hide or pelt with an aldehyde-based treatment agent (A), wherein the optionally (pre) tanned animal hide or pelt is treated with (A) an aldehyde-based treatment agent which may e.g. be
(F) a tanning aldehyde or an aldehyde-based stability and/or fastness improving agent
or (S) an aldehyde-based syntan, and with (H) at least one hydrazine compound which is semicarbazide or aminoguanidine or a salt thereof, which may include semicarbazide or aminoguanidine salts ($H_S$) of phenolsulphonic acid, naphthalene sulphonic acid or naphtholsulphonic acid, in any desired sequence,
or is treated with a reaction product ($A_H$') of (A) with ($H_S$), or with a reaction product ($E_S$) of (S) with (H), or with a mixture of (H) with a reaction product ($A_H$) of (A) with (H), or with a mixture of ($H_S$) with (A) salts ($H_S$), their production and use,
treatment agents for the production of leather, which are mixtures of ($H_S$) with (F) or with (S'), or reaction products ($E_S$) of (S) with (H), or mixtures of (H) with reaction products ($A_H$) of (A) with (H),
the reaction products ($E_S$), their compositions, their production and their use.

25 Claims, No Drawings

PRODUCTION OF TANNED LEATHER AND PRODUCTS SUITABLE THEREFORE

In the production of leather—especially dyed leather—there may be used most various kinds of substrates (hides, pelts) which may have been tanned with conventional tanning agents, such as mineral tanning agents (usually chrome tanning agents), synthetic tanning agents (syntans) and occasionally vegetable tanning agents. The tanned or pre-tanned leather is usually subjected to further treatments before dyeing, in order to provide certain properties to the substrate, such as consistency, suppleness, handle and also dyeability. Such further treatments may include e.g. neutralising, masking, filling, retanning, fatliquoring, etc., and after dyeing, there may follow some further treatments, such as fat-liquoring, fixation, washing, drying, and the dried leather may be subjected to one or more finishing treatments. A particular treatment that may be carried out is the treatment with aldehyde-based products, e.g. for improving the shrinkage temperature of the leather or for improving the fastness properties such as fastness to perspiration, or for providing a mineral-free tannage or in the (re)tanning with aldehyde-based syntans. One essential treatment is a treatment with a synthetic (re)tanning agent, in particular retanning, usually with syntans. A category of syntans that is often employed, because of its satisfactory applicability and properties, is the one of aldehyde-based, especially formaldehyde-based, synthetic tanning agents.

Syntans, in particular phenolic syntans, are a well known catgory of products, in the field of leather production or also in other fields, e.g. textile. JP-A-58-76585 thus discloses a number of natural, semisynthetic and synthetic tannins (as synthetic tannins or "syntans" there being particularly mentioned phenol-formaldehyde resins, thiophenol compounds and dihydroxydiphenylsulphones), which in admixture with certain imino-group-containing compounds (guanidine compounds, amidine compounds, imidoether compounds or isourea compounds) are used for improving the wet fastness, in particular fastness to chlorine, of dyed polyamide based fibers (nylon, wool, silk).

Tanning of animal skins with syntans, which are condensation products from polyhydric phenols, aliphatic aldehyde (in particular formaldehyde) and urea or a derivative of urea, are disclosed in GB-A-353878. GB-A-745000 discloses tanning of animal skins with syntans which are high molecular resins from the condensation of an aliphatic aldehyde (in particular formaldehyde), compounds which react with carbonyl compounds (there are mentioned phenols and some nitrogenous compounds, including amides and azines) and a guanidine compound (among others there are mentioned guanidines, aminoguanidine, dicyandiamide and salts of dicyandiamide). In both documents there is also suggested a further treatment with aldehyde, particularly formaldehyde.

Aldehyde-based, especially formaldehyde-based, synthetic tanning agents employed in the production of leather have, however, often the disadvantage that they may in part hydrolyse or otherwise decompose on standing or even during use, so that the yield may be correspondingly impaired and the backwater may be correspondingly encumbered with by-products. By such decomposition some formaldehyde may be formed, which is then freed and may spread in the ambient, be it when working with the respective (re)tanning agent, be it in the completely treated dry leather. Similarly, when using an aldehydic (in particular formaldehydic) tanning agent, fastness or stability improver or additive for improving the shrinkage temperature, or additive in neutralising, masking or filling, on standing or even during use some formaldehyde may be formed, which is then freed and may spread in the ambient.

In the art it has thus been attempted to improve the yield when working with aldehyde-based treatment agents, in particular syntans and other tanning or further treatment agents, and/or to bind or destroy any free or labile formaldehyde.

In EP-A-526815 for instance there is described a process in which a defined polyisocyanate-derived polymeric product is used in tanning or retanning. These polymeric products have a relatively high affinity for the substrate and thus have a certain modifying influence on the characteristic own properties of leather as compared with a leather (re)tanned in conventional way.

In practice it has also been attempted to destroy the formed formaldehyde by oxidation with peroxides such as sodium perborate or hydrogen peroxide, or to bind it with a sulphite, e.g. by reaction with sodium metabisulphite or with a sulphited tanning agent. In this way a certain improvement can be achieved, but it would be desirable to still further lower the formaldehyde content.

It has now been found that by employing the below defined products (H) it is possible to improve the yield and efficiency of aldehyde-based treatment agents (A) and to lower the free aldehyde, especially formaldehyde content to a surprisingly low level, while the own character of the (re)tanned and optionally further treated substrate is substantially maintained or may even be improved, and that such effect may also be achieved by pre-reacting (H) with an aldehyde-based syntan. It has further also been found that among the products (H) certain salts ($H_S$) are of particular utility.

The invention relates to the process for the production of such (re)tanned leather, to the defined pre-reacted products and defined salts ($H_S$), their compositions, their production and their use.

The invention thus firstly provides a process for the production of tanned and optionally retanned leather comprising the treatment of an optionally (pre)tanned animal hide or pelt with an aldehyde-based treatment agent, wherein the optionally (pre)tanned animal hide or pelt is treated with (A) an aldehyde-based treatment agent selected from
  (F) an aldehydic treatment agent
  and (S) an aldehyde-based syntan, and with (H) at least one hydrazine compound which is semicarbazide or aminoguanidine or a salt thereof, in any desired sequence, or is treated with a reaction product ($E_S$) of (S) with (H).

The aldehydic treatment agent (F) may be any aldehyde or aldehyde-derivative acting as an aldehyde-donor, as conventionally employed in the production of tanned leather, e.g. as a preserving agent, as a tanning agent, as an additive to tanning agents in particular to mineral or vegetable tanning agents, as an additive for improving some of the leather properties. More particularly (F) is selected from an aldehydic treatment agent, especially an aldehydic (in particular formaldehydic) preserving or tanning agent or additive, fastness or stability improver or additive for improving the shrinkage temperature, or additive in neutralising, masking or filling.

As (F) there may be employed any aldehydes as conventionally employed in the respective treatment stages, in particular ($F_1$) an aliphatic low molecular monoaldehyde, ($F_2$) an aliphatic low molecular dialdehyde or higher functional aldehyde and ($F_3$) a modified and/or substituted aliphatic aldehyde.

Suitable examples of ($F_1$) are crotonaldehyde and preferably formaldehyde.

Suitable examples of ($F_2$) are glyoxal, malonaldehyde, succinaldehyde and glutaraldehyde.

Suitable examples of ($F_3$) are acetals, oxazolidines [e.g. 1-azo-3,7-dioxabicyclo-5-ethyl(3,3,0)-octane] or paraldehydes of the mentioned low molecular aldehydes, methylglyoxal, acid or cationic aldehydic compounds, e.g. glyoxylic acid or a tetrakis-(hydroxymethyl)-phosphonium salt e.g. sulphate or chloride, or an oxidized starch (starch dialdehyde).

As a substrate for the treatment with (F), in particular for tanning, there may be used any conventional hides, skins and pelts as are in general employed for tanning, e.g. hides from cow, calf or buffalo (e.g. also as split hides), skins from goat, sheep or pig, buckskins and pelts.

The treatment with (F) may take place at any stage of leather production, as conventional per se for each of the products (F), in particular ($F_1$), ($F_2$) or ($F_3$), and (H) is preferably added after the treatment with (F) as a scavanger for binding any residual or non-bonded aldehyde or aldehyde derivative, especially formaldehyde.

The aldehyde-based syntan (S) may be any such condensation product with tanning, retanning or further special properties.

As syntans (S) there are more particularly meant condensation products of an aldehyde, mainly formaldehyde, with a suitable condensation partner (mainly at least one aromatic component and/or at least one nitrogenous component), as are conventionally employed as tanning or retanning agents or as special treatment agents (e.g. for pretanning, bleaching or filling, or as adjuvants in white tannage, in neutralisation or in dyeing). There may more particularly be mentioned:

Syntans ($S_1$), in which said condensation partners comprise homocyclic aromatic compounds, mainly of the benzenic (in particular phenolic) or naphthalenic series, and which preferably are at least in part sulpho-group-containing, so that the the corresponding syntan is at least colloidally soluble in water, and may also further comprise nitrogenous components;

Syntans ($S_2$), in which said condensation partners are nitrogenous compounds, mainly amidic or/and aminic compounds (including ammonia), and which may optionally be sulpho-group-containing, the sulpho group being e.g. introduced by a conventional sulphitation reaction, e.g. with sodium bisulphite.

Syntans ($S_1$) and ($S_2$) are known products or may be produced by methods known per se.

As (S) there may be employed any tanning or retanning agents based on aldehydes, as are known in the art as syntans and as are conventionally employed in pretanning, tanning or/and retanning or other leather production stages as mentioned above, preferably those at least colloidally soluble in water, more preferably (S') i.e. sulpho-group-containing tanning or retanning agents.

As ($S_1$) there may be mentioned in particular sulpho-group-containing condensation products ($S_1$') of low molecular aldehydes, primarily formaldehyde, with aromatic, at least in part sulphonated hydroxy compounds (in particular phenol, cresol, xylenol, naphthol, resorcinol or pyrocatechol, or condensation products of such products, e.g. diphenylether, dioxydiphenylacetone or dihydroxydiphenylsulphone), and/or naphthalene which may be sulphonated, or also aminated aromatic sulphonic acids, and/or with sulphonated lignins—the reactants being chosen in such a way that there is obtained a sulpho-group-containing condensation product.

As ($S_2$) there may be mentioned in particular condensation products ($S_2$') of low molecular aldehydes, primarily formaldehyde with nitrogenous compounds, or also sulpho-group-containing condensation products ($S_2$") of low molecular aldehydes, primarily of formaldehyde with nitrogenous compounds.

The nitrogenous compounds or reaction partners in ($S_1$), ($S_1$'), ($S_2$), ($S_2$') and ($S_2$") may e.g. be amide and/or amine compounds, e.g. amidic compounds which may be exempt of hydrocarbon radicals and may include heterocyclic compounds containing nitrogen atoms as heteroatoms, or amine compounds, e.g. containing low-molecular preferably aliphatic hydrocarbon radicals, or/and ammonia, optionally in salt form; preferably they are selected from cyanamide, dicyandiamide, urea, thiourea, guanidine, semicarbazide, aminoguanidine, melamine, ammonia and amines [e.g. low molecular aliphatic mono- or oligoamines preferably containing 1–9 carbon atoms, such as mono-, di- or tri-($C_{1-2}$-alkyl)-amines, mono-, di- or tri-(β-hydroxy-$C_{2-3}$-alkyl)-amines, ethylene-diamine, 1,3-propylenediamine, hexamethylenediamine, diethylenetriamine, N-(β-aminoethyl)-1,3-propylenediamine, triethylenetetramine] and salts thereof, more preferably amidic compounds optionally in combination with amine or preferably ammonia (e.g. in a molar ratio amidic/aminic in the range of 1/10 to 100/10, preferably 10/10 to 100/10) more preferably without amine, especially urea and optionally dicyandiamide.

As (S) or (S") there may also be employed combinations of two or more of the above.

Some representative categories of these formaldehyde condensation products (S) are:

- sulpho-group-containing novolaks, preferably from phenol, cresol, naphthalene and/or pyrocatechol (the sulpho groups may be introduced before or after condensation to the novolak), mainly condensates of formaldehyde with phenolsulphonate and/or naphthalenesulphonate;
- sulpho-group-containing condensates of aromatic formaldehyde precondensates with other condensation partners, preferably of a phenolsuphonate/formaldehyde precondensate with naphthalene sulphonate;
- mixed formaldehyde condensates from dioxydiphenylsulphone and ligninsulphonic acid, or from naphtholsulphonic acid and dioxydiphenylsulphone;
- mixed formaldehyde-bisulphite condensate from dioxydiphenylsulphone and dioxydiphenyl-acetone;
- sulpho-group-containing retanning resins such as sulpho-group-containing polymeric formaldehyde condensates with one or more nitrogenous compounds selected from cyanamide, dicyandiamide, urea, thiourea, guanidine, semicarbazide, aminoguanidine, ammonia, amines and melamine, and salts thereof, mainly with urea or/and a melamine or/and dicyandiamide.
- sulpho-group-containing polymeric formaldehyde condensates of aromatic components, e.g. phenols and/or naphthalenes, or precondensates thereof, with one or more nitrogenous compounds selected from cyanamide, dicyandiamide, urea, thiourea, guanidine, semicarbazide, aminoguanidine, ammonia, amines and melamine, and salts thereof, mainly formaldehyde condensates of phenolsulphonate and/or naphthalenesulphonate with urea.

Formaldehyde condensates of nitrogenous compounds selected from cyanamide, dicyandiamide, urea, thiourea, guanidine, semicarbazide, aminoguanidine, ammonia, amines and melamine, and salts thereof, Where a syntan (S) is not water soluble or does not contain a sufficient proportion of hydrosolubilising sites, in particular ammonium or sulpho groups, to be at least colloidally soluble in water, it is preferably combined with a sulpho-group-containing syntan, in particular of the kind of ($S_1$') or ($S_2$"), in which case the latter will also act as a dispersants, to form in water an aqueous dispersion.

A product may typically be regarded as being water soluble, if it gives a true or colloidal solution at a concentration of 3 g/l in water at pH 7 and 20° C., or at least under application conditions.

Preferably in the process of the invention there are employed water soluble syntans, more preferably sulpho-group-containing syntans (S'), in particular ($S_1$') and/or ($S_2$").

More preferably (S) or (S') or ($S_1$') is a formaldehyde-based synthetic tanning agent selected from ($S_1$") a condensate of formaldehyde with phenolsulphonate and urea, or ($S_1$'") a condensate of formaldehyde with naphthalenesulphonate, e.g. as commercially available for tanning or pretanning delimed and optionally pickled hides, skins or pelts or for retanning (pre)tanned leather or for use in neutralisation, filling, bleaching or dyeing. ($S_1$) preferably is ($S_1$'), i.e. a sulpho-group-containing phenolic and/or naphthalenic syntan containing condensed nitrogenous components.

The average molecular weight of (S) may range in the usual broad ranges, e.g. in the range of 200 to 4000, usually 250 to 3000.

These products (S) or (S'), in particular ($S_1$') and ($S_2$"), are suitably employed in the form of aqueous solutions, preferably as concentrated solutions, as usually commercially available, preferably with a dry substance content in the range of 10 to 70%, usually 20 to 60%, e.g. 30–50%, by weight, or in dry form.

According to a further aspect of the invention, there may also be employed a combination of (S) with (F) or of ($E_S$) with (F), i.e. (F) may be employed in admixture with (S) or ($E_S$) or may be added in any desired sequence before, together with or after the addition of (S) or ($E_S$), analogously to conventional methods in the production of dressed (in particular dyed and/or finished) leather or pelts.

The hydrazine compound (H) may be in the free base form or preferably in salt form. For salt formation there may be employed any acids, in particular a mineral acid, e.g. hydrochloric acid, sulphuric acid, nitric acid or phosphoric acid, or carbonic acid, or also a low molecular organic acid, e.g. a carboxylic acid with 1–8 carbon atoms, e.g. formic acid, acetic acid or benzoic acid, or an aromatic sulphonic acid, e.g. benzenesulphonic acid preferably substituted with methyl, or more preferably with hydroxy, with a condensed benzo ring or with a condensed hydroxybenzo ring. The following are particularly worth mention:

aminoguanidine mono- or dihydrochloride,
semicarbazide hydrochloride,
aminoguanidine hemisulphate or sulphate,
aminoguanidine nitrate,
aminoguanidine bicarbonate,
semicarbazide bicarbonate,
aminoguanidine formate,
aminoguanidine acetate,
semicarbazide acetate,
aminoguanidine 4-hydroxybenzenesulphonate,
aminoguanidine naphthalene-1- or -2-sulphonateate,
aminoguanidine 4-, 5- or 7-hydroxynaphthalene-1-sulphonate,
aminoguanidine 1-, 6- or 7-hydroxynaphthalene-2-sulphonate,
aminoguanidine 4-toluolsulphonate,
semicarbazide 4-hydroxybenzenesulphonate,
semicarbazide naphthalene-1- or -2-sulphonateate,
semicarbazide 4-, 5- or 7-hydroxynaphthalene-1-sulphonate,
semicarbazide 1-, 6- or 7-hydroxynaphthalene-2-sulphonate,
semicarbazide 4-toluolsulphonate.

These hydrazine compounds (H) are known compounds or may be produced analogously to known compounds, the salts may be produced e.g. by mixing semicarbazide or aminoguanidine with the salt-forming acid. The salts of the stronger acids, in particular of mineral acids (in particular sulphuric acid, nitric acid, hydrochloric acid, phosphoric acid) or of sulphonic acids, may also be produced by reacting aminoguanidine bicarbonate or semicarbazide bicarbonate or the aminoguanidine or semicarbazide salt of a low molecular carboxylic acid (preferably formic or acetic acid) with the respective mineral acid or sulphonic acid.

They may be employed as dry substances or in the form of aqueous solutions, in particular concentrated solutions of the salt forms, e.g. with a dry substance content in the range of 5 to 70%, usually 10 to 60%, by weight, depending on their solubility.

Particularly worth mention are the salts ($H_S$) which are semicarbazide or aminoguanidine salts of an aromatic monosulphonic acid ($M_S$) selected from phenolsulphonic acid, naphthalene sulphonic acid and naphtholsulphonic acid, and aqueous concentrated solutions of the salts ($H_S$), e.g. with a dry substance content in the range of 5 to 70%, usually 10 to 60%.

The invention thus further provides also a semicarbazide or aminoguanidine salt ($H_S$) of an aromatic monosulphonic acid ($M_S$). The acid ($M_S$) is selected from phenolmonosulphonic acid, naphthalenemonosulphonic acid and naphtholmonosulphonic acid. As acids ($M_S$) there may in particular be mentioned 2-, 3- and 4-hydroxybenzenesulphonic acid, naphthalene-1- or -2-sulphonic acid, 1-hydroxy-2-naphthalenesulphonic acid, 4-hydroxy-1-naphthalenesulphonic acid, 5-hydroxy-1-naphthalenesulphonic acid, 7-hydroxy-1-naphthalenesulphonic acid, 6-hydroxy-2-naphthalenesulphonic acid and 7-hydroxy-2-naphthalenesulphonic acid, to give the corresponding salts ($H_{S1}$) aminoguanidine 2-, 3- or 4-hydroxybenzenesulphonate, naphthalene-1- or -2-sulphonate, 1-hydroxy-2-naphthalenesulphonate, 4-hydroxy-1-naphthalenesulphonate, 5-hydroxy-1-naphthalenesulphonate, 7-hydroxy-2-naphthalenesulphonate, 6-hydroxy-2-naphthalenesulphonate or 7-hydroxy-2-naphthalenesulphonate, or ($H_{S2}$) semicarbazide 2-, 3- or 4-hydroxybenzenesulphonate, naphthalene-1- or -2-sulphonate, 1-hydroxy-2-naphthalenesulphonate, 4-hydroxy-1-naphthalenesulphonate, 5-hydroxy-1-naphthalenesulphonate, 7-hydroxy-1-naphthalenesulphonate, 6-hydroxy-2-naphthalenesulphonate or 7-hydroxy-2-naphthalenesulphonate.

Among these the salts of phenolsulphonic acids and naphthalenesulphonic acids are preferred, in particular the 4-hydroxybenzenesulphonates.

They may be produced by methods analogous to conventional salt forming methods, in particular by reacting ($H_0$) semicarbazide or aminoguanidine or a salt thereof which is a bicarbonate or a salt of a carboxylic acid with ($M_S$).

The reaction may be carried out in a manner conventional per se, preferably in aqueous solution, advantageously at a 0.1M to 10M, preferably 2M to 10M concentration, and at a temperature in the range of 5 to 60° C., preferably with heating, at 25–50° C., the components ($H_0$) and ($M_S$) being admixed with each other at a suitable ratio.

The treatment of the substrate with (A) may take place in conventional way, suitably from an aqueous treatment bath.

The treatment with (H) may take place in any desired sequence with respect to the treatment with (A), i.e. before the treatment with (A), simultaneously with the treatment with (A), e.g. by using a mixture of (A) with (H), or after the treatment with (A), or the treatment with (H) may take place in any desired sequence with respect to a treatment with a reaction product ($A_H$) of (A) with (H), i.e. before a treatment with ($A_H$), simultaneously with a treatment with ($A_H$), e.g. by using a mixture of ($A_H$) with (H), or after a treatment with ($A_H$), or two or more of these variants may be combined. As ($A_H$) there may in particular be mentioned reaction products ($E_S$) of (S) with (H) and reaction products ($A_H$') of (A) with ($H_S$); of the latter particular reference being made also to reaction products ($F_H$) of (F) with ($H_S$).

The invention thus further provides a process for the production of tanned and optionally retanned leather by treatment of an optionally (pre)tanned animal hide or pelt with a synthetic tanning agent, wherein the optionally (pre) tanned animal hide or pelt is treated in an aqueous bath with (S) and is treated with (H) in any desired sequence, or is treated with a reaction product ($E_S$) of (S) with (H).

As a substrate for tanning there may be used any conventional hides, skins and pelts as are in general employed for tanning, e.g. hides from cow, calf or buffalo (e.g. also as split hides), skins from goat, sheep or pig, buckskins and pelts.

The substrates may be in any processing stage before tanning as occurring in the beamhouse (e.g. delimed, bated or pickled), or in the stage of pretanning, tanning or retanning, or even in a subsequent stage before finishing (in particular in the tannery or/and dye-house).

The hydrazine compound (H) and in prticular ($H_S$) may be applied to the substrate suitably in the presence of water, e.g. from an aqueous bath, independently from the stage of application of (S), e.g. in the beamhouse after bating or deliming or in the pickle bath or after pickling, e.g. before or simultaneously with a tanning or pretanning agent, which may e.g. be a syntan (S) or another (pre)tanning agent. If neither the pretanning agent nor the tanning agent is (S), a retanning or other special treatment with (S) can be carried out afterwards.

The concentration of (H) referred to the substrate may vary in a broad range e.g. from 0.1 to 10%, preferably 0.5 to 8%, referred to the weight of the wet substrate. When adding (H) in a stage before the stage of treatment with (S), the partition of (H) in the substrate and in the bath has to be taken into account, in particular if the treatment bath is drained one or more times before treatment with (S).

According to another feature of the invention the hydrazine compound (H) may be applied after tanning, between tanning and retanning, during retanning or even after retanning, at least one of the tanning and retanning agents being (S), preferably (S'), or after the treatment with (F). Also in this variant the concentration of (H) referred to the substrate may vary in a broad range, e.g. from 0.1 to 10%, preferably 0.5 to 8%, referred to the weight of the wet substrate, more preferably 1 to 5%.

The treatment with (H) may take place at the pH and temperature conditions of the treatment stage at which it is added, e.g. in the pH range of 3 to 9 and at a temperature in the range of 10 to 70° C., usually 25 to 60° C., and in a bath length as conventional for leather treatment, or even by direct addition of (H) in dry form or as a solution as mentioned above, to the wet leather, i.e. in a bath length of 0% or more, in particular that may range in the scope of 0 to 400%, more particularly, when (H) in the dry form or in the form of an aqueous solution as described above is added to the wet leather e.g. in the range of 0 to 40% referred to the weight of the wet substrate or, when (H) in the dry form or in the form of an aqueous solution as described above is added to an aqueous leather treatment bath, which is e.g. in the range of 40 to 400%, preferably 60 to 300%, referred to the weight of the wet substrate. The treatment time may be as suitable per se for each of the usual treatment stages. If (H) is added separately the treatment time advantageously is in the range of 10 minutes to 6 hours, preferably 10 minutes to 2 hours, more preferably 15 to 60 minutes.

For the production of the tanned and dyed leather usually the following main treatment stages are carried out:

Tannage, e.g. with a mineral, vegetable or aldehyde tanning agent,

Neutralization,

Optionally masking and/or filling

Retannage,

Dyeing (in one or more stages optionally with inserted charge reversal of the substrate), Fatliquoring, Fixation, Washing and/or rinsing, Drying.

The product (H) may be added during any one or more of the above stages, or between any two of the above stages. Advantageously (H) may be added during neutralization, during masking or filling, simultaneously with retannage, after retannage, during dyeing or fatliquoring or together with washing.

According to a particular feature of the invention (H) may be added in two or more stages, one together with or immediately after retannage, or by retanning with ($E_S$), and one ore more in subsequent stages, at least one thereof being carried out after fixation, preferably with washing.

According to a particular feature of the invention the syntan (S), preferably (S'),—provided that it contains at least one reactive methylol group and/or some free or labile formaldehyde e.g. also in the form of a labile $CH_2$-bridge—is pre-reacted with (H). In particular any available methylol groups and/or free or labile formaldehyde in (S) may be reacted with the highly reactive hydrazine compound (H). The reaction may take place in a very broad temperature and pH range, e.g. at a pH in the range of 3 to 11, preferably 4 to 10, and at a temperature in the range of 15 to 120° C., preferably 20 to 70° C., especially with heating, preferably at a temperature>30° C., more preferably in the range of 40–70° C., especially 50–70° C., typically at about 60° C. The reaction expediently takes place in aqueous solution, at a suitable concentration, e.g. at an (S)- or (S')-concentration in the range of 5 to 70%, usually 10 to 50%, by weight. The reaction time may vary depending on the employed products and their concentrations and on the employed pH and temperature, e.g. between a few minutes and a few hours, preferably in the range of 2 minutes to 4 hours, more preferably 5 minutes to 3 hours.

The quantitative ratio of (H) to (S) for this reaction may vary depending on the kind of starting product (S). A suitable weight ratio of (H) to (S) is e.g. in the range of 0.02/100 to 10/100, preferably 0.1/100 to 8/100. If (S) or (S') is ($S_1$) the weight ratio of (H) to ($S_1$) is e.g. in the range of 0.02/100 to 4/100, preferably 0.1/100 to 2/100, very satisfactory results being achievable even at very low ratios, especially already at weight ratios (H)/($S_1$)<1/100, in particular in the range of 0.1/100 to 0.9/100. If (S) or (S') is ($S_2$) the weight ratio of (H) to ($S_2$) is e.g. in the range of 0.4/100 to 10/100, preferably 1/100 to 8/100, more preferably 2.5/100 to 6/100.

By this reaction of (H) with (S) there is formed an aldehyde-based modified (re)tanning agent ($E_S$)—or by the reaction of (H) with (S') there is formed an aldehyde-based modified (re)tanning agent ($E_S$')—in which at least some of the available methylol groups or/and formaldehyde or/and a labile methylene bridge has reacted with (H).

By the reaction of (S) with (H) one or more of the available nitrogen-bonded hydrogen atoms of (H) or ($H_S$)—e.g. up to 6 for aminoguanidine or up to 5 for semicarbazide, or optionally even more if the product is protonated—may react with corresponding available formyl groups or methylol groups present in (S), in commercial forms of (S) or in a leather produced by a process comprising a treatment with (S). Preferably, however, the reaction is carried out in such a way that only one to two thereof are reacted, so that a substantial proportion of the reactive sites is still available for scavenging any further aldehyde that may occur in the process or in the treatment.

Where the polymeric syntan molecule of (S) or (S') is reactive with (H), e.g. by containing one or more methylol groups, by this reaction there is formed an aldehyde-based modified (re)tanning agent (E) that contains the syntan-characteristic radical of (S) or respectively (S') and the introduced radicals of (H), in particular an optionally protonated aminoguanidine or semicarbazide radical (T), in the base form or in the form of a salt thereof, e.g. linked over a CH— or $CH_2$-bridge to the backbone of the molecule of a formaldehyde-based modified (re)tanning agent (E), or as a hydrazone. The radical (T) may be linked through one or more of its heteroatoms, with or without formation of a heterocyclic (e.g. triazoline) ring.

The radical (T) may e.g. be a mono- or divalent radical that, where it is bonded through one or two of its terminal nitrogens, may in one of its tautomeric forms, correspond to one or more of the formulae

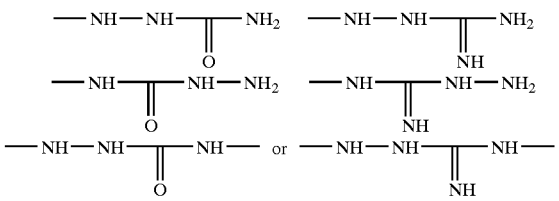

and is optionally protonated with a salt-forming acid, in particular those mentioned above.

Where some free or labile formaldehyde is present in (S), this may simultaneously also be reacted with (H) and the reaction may lead to condensation products containing the above radicals or also to cyclic compounds e.g. a 3-amino-1,2,4-triazoline, a 1,2,4-triazoline-3-one or guanylhydrazone, which may also be in a corresponding salt form.

Where (S) contains any labile methylene bridges, e.g. between two aromatic rings or between two nitrogen atoms, or decomposition of (S) has lead to fragmentation of the molecule to methylol-group-containing fragments of (S), this is also reacted with (H) to give fragments of (S) containing at least one group (T) linked to said fragments.

The resulting reaction product may thus comprise a (re)tanning agent (E), a 3-amino-1,2,4-triazoline, a 1,2,4-triazoline-3-one or guanylhydrazone or/and a fragmentary syntan (B) which is a fragment of (S) containing at least one group (T) linked to it, or a mixture of two or more thereof, or a mixture of one or more thereof with (S).

Analogously (F) can be reacted with ($H_S$) to give an aldehyde-based reaction product ($F_H$), in particular ($F_{1H}$), ($F_{2H}$) and ($F_{3H}$), which are the reaction products of ($F_1$), ($F_2$) and respectively ($F_3$) with ($H_S$), as ($F_{1H}$) there being meant in particular those reaction products in which 1 mole of ($H_S$) is reacted with more than 1 mole of ($F_1$).

Analogously as mentioned above for the reaction of (S) with (H), also by the reaction of (F) with ($H_S$) one or more of the available nitrogen-bonded hydrogen atoms of ($H_S$) may react with corresponding available formyl groups or methylol groups present in (F), in commercial forms of (F) or in a leather produced by a process comprising a treatment with (F). Preferably, however, the reaction is carried out in such a way that only one to two thereof are reacted.

The invention thus also provides an (H)-modified treatment agent for the production of leather, which is a reaction product ($F_H$), in particular ($F_{1H}$), ($F_{2H}$), ($F_{3H}$), or especially ($E_S$) or ($E_S$'), or is a mixture of (H) with ($A_H$), in particular with ($E_S$) or ($E_S$') or with ($F_H$), or is a mixture of ($H_S$) with (A), in particular with (S) or (S') or with (F). More particularly it provides an (H)-modified aldehyde-based syntan ($E_S$) or ($E_S$') as defined above, which preferably is a (re)tanning agent (E) as defined above or an (H)-modified (re)tanning product ($E_X$) which is a mixture comprising two or more components selected from a tanning agent (E), a 3-amino-1,2,4-triazoline, a 1,2,4-triazoline-3-one or guanylhydrazone, and a fragmentary syntan (B) which is a fragment of (S) containing at least one group (T) linked to it, or a mixture of one or more thereof with (S), provided that it comprises at least one of (E) and (S), or a mixture of ($E_S$) or ($E_S$') with (H). Where (H) is present in admixture with other components as mentioned above, it is expediently present in an efficient amount, preferably the weight ratio of (H) to the other components (A) or ($A_H$) is>2/100, e.g. in the range of 5/100 to 500/100.

The invention thus further provides a process for the production of a (T)-containing, aldehyde-based syntan ($E_S$) or ($E_S$') as defined above, which is in particular a synthetic tanning agent (E) or product ($E_X$) as defined above, which process is characterised in that an aldehyde-based synthetic tanning agent (S) or (S')—in particular wherein the syntan (S) or (S') contains some free or labile formaldehyde or/and at least one methylol group as a substituent in the molecule—is reacted with at least one hydrazine compound or salt (H) in aqueous medium.

By the reaction with (H) the average molecular weight of (S) may be stabilised or increased accordingly to the one of ($E_S$), which may e.g. be up to 200%, preferably up to 150%, e.g. up to 120% the average molecular weight of (S), in particular in the range of 102 to 200%, preferably 105 to 150%, e.g. 105 to 120% of the average molecular weight of (S). The average molecular weight of ($E_S$) may vary in a broad range depending on the starting products, their ratio and the employed reaction conditions, e.g. in the range of 250 to 6000, especially 300 to 5000.

The products ($E_S$) contain the syntan-characteristic skeleton portions of (S) from which they derive and radicals of (H) [in particular (T) as mentioned above]; those derived from (S') [i.e. ($E_S$')] further contain sulpho groups and are thus amphoteric. The sulpho groups in ($E_S$')—depending on the pH—may be in free acid form or in salt form, in particular in the form of an inner salt with salt-forming radicals (T) or in the form of salts with cations as conventional in (S'), including alkali metal cations, usually potassium or preferably sodium and ammonium and/or other organic bases as per se conventionally employed in syntans.

The product ($E_S$), preferably ($E_S$'), may be e.g. in the form of an aqueous composition, preferably a concentrated solution, of the syntan stabilized with (H) or may, if desired, also be dried to a powder or granular product. The concentrated aqueous solutions of an (H)-stabilized or (H)-modified syntan preferably have an ($E_S$)- or ($E_S$')-concentration in the range of 10 to 70%, usually 20 to 60%, e.g. 30 to 50%, by weight.

The stabilization reaction with (H) preferably is carried out under such conditions and to such a degree that the analysable formaldehyde content is reduced by a substantial degree, preferably to so little that the analysable formaldehyde content is below 200 ppm referred to the dry substance, more preferably below 100 ppm, and remains at this level even after prolonged storage e.g. of up to 2, 3, 6 or even more, e.g. up to 24 months. The suitable and in particular optimum (H)-quantity for a given (S) and the suitable or respectively optimum reaction parameters and conditions can be assessed by means of a few preliminary trials. The formaldehyde level can be determined by analytical methods known per se, or by methods analogous to known methods. A preferred analytical method consists in extracting the product or the dry leather with saturated water vapour at a temperature between 50 and 70° C., preferably at 60° C., reacting the extracted aqueous formaldehyde with acetylacetone buffered with ammonium acetate and assessing the formaldehyde content by UV-visual spectrometer detection; this analytical method allows a detection of a formaldehyde content as low as 3 ppm.

The products ($E_S$) can be used in the same way as known aldehyde-based syntans (S) for pretanning, tanning or retanning, and thus the invention further provides a process for the production of tanned and optionally retanned leather, wherein the pretanning, tanning or/and retanning bath comprises a tanning agent ($E_S$) as defined above and which preferably is (E) or a 3-amino-1,2,4-triazoline or a 1,2,4-triazoline-3-one or a fragmentary syntan (B) which is a fragment of (S) containing at least one group (T) linked to it, or a mixture of two or more thereof, or a mixture of one or more thereof with (S), provided that it comprises at least one of (E) and (S), and may—if desired—be followed by a treatment with (H) after fixation. Also here (S) preferably is (S') and ($E_S$) preferably is ($E_S$').

Analogously, the products ($F_H$) can be used in the same way as known aldehydic treatment agents (F), in particular ($F_1$), ($F_2$) or ($F_3$), in the respective tanning or other aldehyde treatment process in the production of leather.

For the retanning process of the invention there may be employed any kinds of leather as are conventionally employed for a retanning from aqueous medium, e.g. grain leather (such as nappa from sheep, goat or cow and box-leather from calf or cow), suede-leather (such as velours from calf-leather, sheepskin and goatskin and also hunting leather), split-leather (e.g. from cow, pig and optionally also calf-skin,), buffalo-leather, buckskin and nubuk leather; further also wooled skins and furs. The leathers may have been (pre)tanned by any tanning method, e.g. vegetable, mineral, synthetic or combined tanned (e.g. chrome-tanned, zirconyl-tanned, aluminium-tanned or semi-chrome-tanned).

The leathers may be of various thicknesses. There may be employed very thin leathers, such as book-binders leather or glove-leather (nappa), leather of medium thickness, such as shoe-upper leather, garment leather and leather for handbags, or also thick leathers, such as upholstery leather, leather for suitcases, for belts and for sport articles; woolled skins and furs may also be employed.

Before the retanning process of the invention, the pH of the leather may advantageously be set to values in the range of 4 to 8 (the leather is "neutralised"). Depending on the kind of the leather, there may be chosen an optimum pH-range, e.g. for grain leather pH-values in the range of 4 to 7, preferably 5 to 6.5, for suede-leather and split velours and for very thin leathers pH-values in the range of 4.5 to 7, while for intermediately dried suede leathers and intermediately dried split-velours the pH may range in the scope of 5 to 7. For the adjustment of the pH-value of the leather there may be employed conventional assistants: for tanned leather of acidic character, the pH may be adjusted by addition of salts of weak acids, e.g. sodium formate, sodium acetate, sodium carbonate, sodium bicarbonate or sodium sulphite, among which sodium formate and sodium bicarbonate are preferred. Sodium carbonate and sodium bicarbonate may advantageously be employed in particular as secondary basis for the exact adjustment of the superficial pH-value of the leather. Mineral tanned leather may, if desired, also be masked, e.g. with alkali metal formate, oxalate or polyphosphate.

The retanning of the invention with the retanning agent ($E_S$), preferably with the amphoteric retanning agent ($E_S$'), is carried out expediently in aqueous medium and may take place under retanning conditions (in particular temperature, pH-value and concentration) as conventional per se for (S) or respectively (S'), advantageously at temperatures in the range of 10 to 70° C., preferably 20 to 60° C., and at pH-values of advantageously 4 to 8, preferably 4.5 to 7.5. The adjustment of the pH-value is advantageously carried out for so long, until in the liquor and in the cross-section there is achieved an equilibrium in the mentioned pH-range. The concentration of the retanning agent ($E_S$), referred to the substrate, is advantageously in the range of 0.04 to 20% by weight, preferably in the range of 0.1 to 10% by weight referred to the wet leather being processed. The duration of the retanning treatment with ($E_S$) may vary depending on the substrate, the apparatus, the treatment parameters and the kind of ($E_S$); in general it ranges advantageously in the scope of 20 minutes to 2½ hours, preferably in the scope of 30 minutes to 2 hours.

If desired the retanning agents ($E_S$) of the invention may be blended with inert fillers or/and with vegetable or other synthetic retanning agents or may be combined in a multi-step retanning with vegetable or/and other synthetic retanning agents.

As vegetable and synthetic retanning agents, that may be combined in a one-step or multi-step retanning process with the retanning agent ($E_S$), are suitable any desired of these retanning agents [e.g. quebracho, chestnut or mimosa extracts, polyurethane, (meth)acrylic acid based (co)polymers or also further formaldehyde-based syntans such as aromatic syntans, melamine/-, dicyandiamide/- and/or urea/formaldehyde resins and combinations of two or more thereof].

The leathers retanned according to the invention may be dyed in a manner known per se with dyestuffs suitable for the dyeing of leather. As dyes come principally into consideration anionic or also non-ionic dyes that are sufficiently water soluble in order to be employed for the dyeing of leather from aqueous medium and that, in particular, contain at least one water solubilizing sulphonic acid or carboxylic acid group, optionally in salt form, or/and at least one water solubilizing sulphonamide group, or also metal complexes or reduced sulphur dyes that are otherwise sufficiently water soluble. The dyeing may take place in the same bath or also in a fresh bath and may be carried out under conditions conventional per se, principally at temperatures in the range of 20 to 80, preferably 25 to 60° C. The pH-values of the dyebath may range in broad scopes, principally from pH 8 to pH 3; in general it is of advantage to start the dyeing at higher pH-values and to conclude it at lower pH-values. Preferably dyeing is carried out at pH-values≧4, in particular in the pH-range of 8 to 4, and for the conclusion of the dyeing procedure the pH-value is advantageously lowered (e.g. by addition of an acid conventional in leather dyeing, in particular acetic acid or formic acid), preferably to values in the range between 4 and 3. The dyeing may optionally be carried out in the presence of conventional dyeing assistants, e.g. of build-up assistants of preferential dyestuff affinity (e.g. highly oxyethylated and optionally quaternized fatty amines or fatty-amino-alkylamines).

The leathers or pelts may, if desired be fatted before and/or after the dyeing; if desired a fat-liquor may also be employed before, simultaneously with or/and after the treatment with ($E_S$) and before the dyeing. Any known fat-liquors, as otherwise conventionally employed from aqueous medium for the fatting of leather, are suitable, in particular animal, vegetable or mineral fats, oils or waxes or chemically modified animal or vegetable fats or oils, or further synthetic leather-fatting agents. The following may be mentioned as examples: tallow, fish oil, neats-foot oil, olive oil, castor oil, rape-seed oil, cottonseed oil, sesam oil, corn oil and Japanese tallow and chemically modified products thereof (e.g. hydrolysis, transesterification, oxidation, hydrogenation or sulphonation products), bees wax, Chinese wax, carnauba wax, montan wax, wool fat, birch oil, mineral oil with boiling range between 300 and 370° C. (especially the so-called "heavy alkylates"), soft paraffin, medium paraffin, vaseline, methylesters of $C_{14-22}$-fatty acids and esters, in particular partial esters, of polybasic acids (e.g. phosphoric acid) with optionally oxyethylated fatty alcohols. For fatliquoring there are preferably employed aqueous fat-liquor emulsions, in which the fat-liquor is emulsified with the aid of an emulsifier and/or by chemical modification. For the use before dyeing there are preferred as fat-liquors, oils and their chemical modification products; the phosphoric acid esters and fatting agents of non-oily character but rather of waxy character are advantageously employed only after the dyeing.

For fatting after the dyeing procedure the fatting agent is advantageously added before the pH-value of the liquor is lowered, to values preferably in the range of 3 to 4. A conventional leather softener, in particular a cationic leather softener may, if desired, be applied in a final step, particularly if fatting has been carried out with a sulphonated fatliquoring agent.

The so-treated substrates may then be further treated in conventional manner, e.g. rinsed or/and washed, drained, set out and dried. If desired some (H) may be added after dyeing, in particular during washing.

By the (H)-modification of the invention the (re)tanning efficiency of (S) or respectively ($E_S$) is substantially not impaired, but there is rather achieved an improvement in the stability of the (re)tanning syntan and also an improvement in the stability of the handle or feeling of the treated leather.

In the following examples parts and percentages are by weight; if not otherwise indicated, in the leather treatment examples the percentages refer to the weight of the wet substrate; the temperatures are indicated in degrees Celsius; the chemicals employed as starting products are commercially available products. The formaldehyde content of the compositions or in the dried leather is assessed by extraxction with saturated water vapour at 60° C. for 3 hours and reaction of the extracted material with acetylacetone with UV-visual spectrometer detection; this analytical method allows a detection of a formaldehyde content as low as 3 ppm. If in any of the following examples free formaldehyde in the product is not detectable, this means that its content is below 3 ppm.

EXAMPLE 1

A phenolic syntan, which is a condensate of phenolsulphonic acid, phenol, urea and formaldehyde in the molar ratio of 2:1:1.2:4, in the form of 50% aqueous solution and neutralised to pH 6 with sodium hydroxide, and which contains 400 ppm formaldehyde referred to dry substance, is mixed with 2%, referred to dry substance, of aminoguanidine bicarbonate. In the obtained product no free formaldehyde is detectable. After 6 months storage at 20–25° C. and 50% relative humidity (RH), the product is tested again and no formaldehyde is detectable.

EXAMPLE 2

The product of Example 1, which is an aqueous solution with 50% dry substance content, is spray dried to give a powder product. No formaldehyde is detectable in the dry product either 24 hours after drying or after 6 months storage in a sealed container.

EXAMPLE 3

In a three-necked reactor of 3 l volume, fitted with stirrer, thermometer and reflux-condenser, 150 ml of water and 150 g of aminoguanidine bicarbonate are added and stirred for 5 minutes, then an aqueous solution of 4-phenolsulphonic acid of 60% concentration is added dropwise with stirring until the pH has dropped to pH5, and the mixture is heated to keep the temperature at 40–45° C. Stirring is continued until $CO_2$-evolution has ceased, then the heating is disconnected and the product is allowed to cool to ambient temperature.

EXAMPLE 4

A wet blue bovine leather of 1.6 mm thickness with undetectable formaldehyde content, is cut into squares of 30 cm×30 cm and each one of six pieces is treated in a rotating drum in the following way.

1. The piece of wet blue leather is put into the drum, 100% of water at 25° C., 0.5% of sodium formate and a suitable amount of sodium bicarbonate for achieving the desired neutralization are added and the drum is rotated for more than 1 hour until the leather substrate has achieved a uniform pH (tested by means of pH indicator) and the liquor has a pH within the range of 5 and 5.5.

2. The liquor is drained and 150% of water at 35° C. is added and the drum is rotated for 10 minutes.
3. The bath is drained and 100% of water at 35° C. are added, 4% of a retanning resin, which is a sulpho-group-containing formaldehyde condensation product of dicyandiamide and urea of average molecular weight=600, is added thereto and the drum is run for 45 minutes.
4. Aminoguanidine bicarbonate in the indicated concentration of x % is added and the drum is run for 30 minutes.
5. The bath temperature is raised to 45° C. and 2% of a leather dye (Colour Index Direct Black 168, in a commercially available dry form with 40% dye content) is added and the drum is rotated for one hour.
6. 6% of a fatliquoring agent (sulphited fish oil of 80% concentration) is added and the drum is rotated for one hour.
7. Formic acid of 85% concentration is added in order to lower the pH to 3.6–3.8 and the drum is run for 30 minutes.
8. The bath is drained and the treated leather is washed with 150% of cold water for 10–20 minutes.
9. The treated leather is discharged, left hanging over night and air-dried.

The so treated leather is conditioned for more than 72 hours at 20° C. and 50% RH and is then tested for formaldehyde contents. For testing, the leather is extracted with saturated water vapour at 60° C. for 3 hours, the extraction liquor is reacted with acetylacetone buffered with ammonium acetate. The resulting coloured solution is measured by means of UV-vis spectrometer.

The concentrations x % and the assessed formaldehyde content in the dried leather are set out in the following table

| x % | formaldehyde content in the dried leather |
|---|---|
| 0% (= blank) | >400 ppm |
| 2.5% | 45 ppm |

the leather treated with the aminoguanidine bicarbonate is stored for 6 months at 20–25° C. and 50% RH and is then analysed again for formaldehyde content. No change in formaldehyde content can be determined.

EXAMPLE 5

The procedure described in Example 4 is repeated, with the difference that, instead of aminoguanidine bicarbonate there is employed the equivalent amount (i.e. the amount corresponding to the same aminoguanidine offer) of the aminoguanidine 4-phenolsulphonate produced in Example 3.

EXAMPLE 6

Pickled cattle hide piece is placed in a rotating drum and 100% of water and 1% of tetrakis-hydroxymethyl phosphonium sulphate are added. After rotating for 2 hours at room temperature, the pH of the drum contents is increased to 5.5 gradually over 2 hours by adding suitable quantities of sodium bicarbonate. 2% of aminoguanidine bicarbonate is added and the drum is rotated for a further 30 minutes. The formaldehyde content of the drum liquor and of the leather produced, after drying, is by 75% inferior to the one of the control liquor and respectively to the one of the leather produced without treatment with aminoguanidine bicarbonate.

EXAMPLE 7

Leather as used in example 4 is treated by the same process as in example 4, with the difference that instead of 4% of retanning resin there are employed 2% thereof in step 3, and aminoguanidine bicarbonate in varying concentrations x % is used in step 4. The resulting leather is tested for free formaldehyde contents by the method described in example 4. The results are set out in the following table

| x % | formaldehyde content in the dried leather |
|---|---|
| 0 (= blank) | >250 ppm |
| 0.5% | 220 ppm |
| 1% | 194 ppm |
| 2% | 42 ppm |
| 3% | 7 ppm |

EXAMPLE 8

Leather as used in Example 4 is treated by the same process as in Example 4, with the difference that 2% of aminoguanidine bicarbonate are added in different stages. The resulting leather is tested for free formaldehyde contents by the method described in Example 4. The results are set out in the following table

| addition | formaldehyde content in the dried leather |
|---|---|
| none (= blank) | >350 ppm |
| in step 1 | 290 ppm |
| in step 4 | 220 ppm |
| just before step 5 | 207 ppm |
| in step 7 | 117 ppm |

EXAMPLE 9

A syntan manufactured from urea, dicyandiamide, sodium metabisulphite and formaldehyde in the molar ratio of 1:1:0.2:4, in the form of a 50% aqueous solution, at pH 6 (adjusted with sodium hydroxide), is mixed with y %, referred to dry substance, of aminoguanidine bicarbonate for 2 hours at 60° C. The obtained product is analysed for free formaldehyde using the vapor extraction and detection method described above. The formaldehyde contents are set out in the following table.

| y % | analysed formaldehyde content in the product |
|---|---|
| 0% (= blank) | 630 ppm |
| 1% | 580 ppm |
| 2% | 244 ppm |
| 3% | 93 ppm |
| 5% | 91 ppm |

EXAMPLE 10

A phenolic syntan, manufactured as in Example 1 above, is treated as in Example 1 with y %, referred to dry substance, of aminoguanidine bicarbonate for 2 hours at 60° C. The obtained product is analysed for free formaldehyde using the vapor extraction and detection method described above. The formaldehyde contents are set out in the following table.

| y % | analysed formaldehyde content in the product |
|---|---|
| 0% (= blank) | 35 ppm |
| 0.1% | 22 ppm |
| 0.2% | 21 ppm |
| 0.5% | 17 ppm |
| 1% | 4 ppm |

EXAMPLE 11

The procedure described in Example 10 is repeated, with the difference that, instead of aminoguanidine bicarbonate there is employed the equivalent amount (i.e. the amount corresponding to the same aminoguanidine offer) of the aminoguanidine 4-phenolsulphonate produced in Example 3.

EXAMPLE 12

A syntan manufactured from formaldehyde, dicyandiamide and ammonium chloride in the molar ratio of 1:0.6:0.4 in the form of a 45% aqueous composition, is mixed with y %, referred to dry substance, of aminoguanidine bicarbonate for 2 hours at 60° C. The obtained product is analysed for free formaldehyde using the vapor extraction and detection method described above. For y=0 the formaldehyde content is 2100 ppm, whereas for y=2 the formaldehyde content is 910 ppm.

Analogously as aminoguanidine bicarbonate, equivalent amounts of aminoguanidine mono- or di-hydrochloride, semicarbazide hydrochloride, aminoguanidine hemisulphate or sulphate, aminoguanidine nitrate, semicarbazide bicarbonate, aminoguanidine formate, aminoguanidine acetate, semicarbazide acetate and aminoguanidine benzoate may be employed in each of the above Examples 1, 2, 4, 6–10 and 12.

What is claimed is:

1. A process for the production of tanned and optionally retanned leather comprising the treatment of an optionally (pre)tanned animal hide or pelt with an aldehyde-based treatment agent, wherein the optionally (pre)tanned animal hide or pelt is treated with (A) an aldehyde-based treatment agent selected from (F) an aldehydic treatment agent and (S) an aldehyde-based syntan, and is treated with a salt ($H_S$) which is a semicarbazide or aminoquanidine salt of an aromatic monosulphonic acid ($M_S$) selected from phenolsulphonic acid, naphthalene sulphonic acid and naphtholsulphonic acid, in any desired sequence, or is treated with a reaction product ($E_S$) of (S) with ($H_S$).

2. A salt ($H_S$) which is a semicarbazide or aminoguanidine salt of an aromatic monosulphonic acid ($M_S$) selected from phenolsulphonic acid, naphthalene sulphonic acid and naphtholsulphonic acid.

3. A process for the production of a salt ($H_S$) according to claim 2, wherein ($H_0$) semicarbazide or aminoguanidine or a salt thereof which is a bicarbonate or a salt of a carboxylic acid is reacted with ($M_S$).

4. A process for the production of an aldehyde-based treatment agent ($A_H'$) for the production of leather, wherein an aldehyde-based treatment agent (A) which is an aldehyde-based treatment agent selected from (F) an aldehydic treatment agent and (S) an aldehyde-based syntan, is reacted with a salt ($H_S$) which is a semicarbazide or aminoguanidine salt of an aromatic monosulphonic acid ($M_S$) selected from phenolsulphonic acid, naphthalene sulphonic acid and naphtholsulphonic acid.

5. A process according to claim 1, wherein (A) is employed in admixture with ($H_S$).

6. A process according to claim 1 wherein ($H_S$) is at least in part prereacted with (A) to form ($A_H'$).

7. A process according to claim 6, wherein ($A_H'$) is ($F_H$), which is a reaction product of (F) with ($H_S$).

8. A process according to claim 1, wherein (F) is an aldehydic preserving or tanning agent or adjuvant, fastness or stability improver or additive for improving the shrinkage temperature, selected from ($F_1$) an aliphatic low molecular monoaldehyde, ($F_2$) an aliphatic low molecular dialdehyde or higher functional aldehyde and ($F_3$) a modified and/or substituted aliphatic aldehyde.

9. A process according to claim 1 for the production of tanned and optionally retanned leather by treatment of an optionally (pre)tanned animal hide or pelt with a synthetic tanning agent, wherein the optionally (pre)tanned animal hide or pelt is treated in an aqueous bath with (S) and is treated with ($H_S$) in any desired sequence, or is treated with a reaction product ($E_S$) of (S) with ($H_S$).

10. A process according to claim 1, wherein (S) is a sulpho-group-containing, formaldehyde-based syntan (S') and ($E_S$) is a sulpho-group-containing reaction product ($E_S'$) of (S') with ($H_S$).

11. A process according to claim 1, wherein (S) is a formaldehyde-based syntan selected from ($S_1$) a sulpho-group-containing phenolic and/or naphthalenic syntan optionally containing condensed nitrogenous components, or ($S_2$) a polymeric formaldehyde condensate with one or more nitrogenous compounds.

12. A process according to claim 11, wherein (S) is a nitrogen-containing formaldehyde-based syntan selected from ($S_1'$) a sulpho-group-containing phenolic and/or naphthalenic syntan containing condensed nitrogenous components, ($S_2''$) a sulpho-group-containing polymeric formaldehyde condensate with one or more nitrogenous compounds or ($S_2'$) a polymeric formaldehyde condensate with one or more nitrogenous compounds, optionally in admixture with at least one of ($S_1'$) and ($S_2''$), and the nitrogenous components or compounds are selected from cyanamide, dicyandiamide, urea, thiourea, guanidine, melamine, ammonia and amines and salts thereof.

13. A process according to claim 1, wherein ($E_S$) comprises (E) which is an aldehyde-based synthetic tanning agent containing an optionally protonated aminoguanidine or semicarbazide radical (T) linked over a CH— or $CH_2$-bridge to the backbone of the molecule, or an (H)-modified (re)tanning product ($E_X$) which is a mixture comprising two or more components selected from a tanning agent (E), a 3-amino-1,2,4-triazoline, a 1,2,4-triazoline-3-one, guanylhydrazone and a fragmentary syntan (B) which is a fragment of (S) containing at least one optionally protonated group (T) linked to it, or a mixture of one or more thereof with (S).

provided that it comprises at least one of (E) and (S).

14. A process according to claim 9, wherein (S) or ($E_S$) is employed in combination with (F).

15. A process according to claim 9, wherein the (re) tanning bath comprises a (re)tanning agent ($E_S$).

16. A treatment agent suitable for the production of leather by the process according to claim 1, which is a mixture of ($H_S$) with (F) or with (S'), or a reaction product ($E_S$) of (S) with ($H_S$), or a mixture of ($H_S$) with a reaction product ($A_H$) of (A) with ($H_S$), where ($H_S$) is a semicarbazide or aminoguanidine salt of an aromatic monosulphonic acid, ($M_S$) selected from phenolsulphonic acid, naphthalene sulphonic acid and naphtholsulphonic acid, and (S') is a sulpho-group-containing, formaldehyde-based syntan (S).

17. A (T)-containing, aldehyde-based synthetic tanning agent ($E_S$) comprising (E) which is an aldehyde-based synthetic tanning agent containing an optionally protonated aminoguanidine or semicarbazide radical (T) linked over a CH— or $CH_2$-bridge to the backbone of the molecule, or an (H)-modified (re)tanning product ($E_X$) which is a mixture comprising two or more components selected from a tanning agent (E), a 3-amino-1,2,4-triazoline, a 1,2,4-triazoline-3-one, guanylhydrazone and a fragmentary syntan (B) which is a fragment of (S) containing at least one optionally protonated group (T) linked to it, or a mixture of one or more thereof with (S), provided that it comprises at least one of (E) and (S)

wherein ($E_S$) is a reaction product of (S) with ($H_S$), ($H_S$) is a semicarbazide or aminoguanidine salt of an aromatic monosulphonic acid, ($M_S$) selected from phenolsulphonic acid, naphthalene sulphonic acid and naphtholsulphonic acid, and (S) is an aldehyde-based syntan.

18. A (T)-containing, aldehyde-based synthetic tanning agent ($E_S$) according to claim 17, which is sulpho-group-containing.

19. A (T)-containing, aldehyde-based synthetic tanning agent ($E_S$) according to claim 17, comprising anions of ($M_S$), which are aromatic monosulphonic acids selected from phenolsulphonic acid, naphthalene sulphonic acid and naphtholsulphonic acid.

20. A composition of a treatment agent for the production of leather, comprising a treatment agent according to claim 16.

21. A composition according to claim 20 comprising a (T)-containing, aldehyde-based synthetic tanning agent ($E_S$) comprising (E) which is an aldehyde-based synthetic tanning agent containing an optionally protonated aminoguanidine or semicarbazide radical (T) linked over a CH— or $CH_2$-bridge to the backbone of the molecule, or an (H)-modified (re)tanning product ($E_X$) which is a mixture comprising two or more components selected from a tanning agent (E), a 3-amino-1,2,4-triazoline, a 1,2,4-triazoline-3-one, guanylhydrazone and a fragmentary syntan (B) which is a fragment of (S) containing at least one optionally protonated group (T) linked to it, or a mixture of one or more thereof with (S), provided that it comprises at least one of (E) and (S), in the form of an aqueous solution or as a dry powder or granular product.

22. A process for the production of a (T)-containing, aldehyde-based synthetic tanning agent ($E_S$) according to claim 17, wherein an aldehyde-based syntan (S) is reacted with at least one hydrazine compound salt ($H_S$) in aqueous medium, and is optionally dried.

23. A process according to claim 1, wherein (pre)tanned leather is retanned with an aldehyde-based syntan (S) or ($E_S$).

24. A treatment agent suitable for the production of leather by the process according to claim 9, which is a mixture of ($H_S$) with (F) or with (S'), or a reaction product ($E_S$) of ($H_S$), or a mixture of ($H_S$) with a reaction product ($A_H$) of (A) with ($H_S$), wherein ($H_S$) is a semicarbazide or aminoguanidine salt of an aromatic monosulphonic acid ($M_S$) selected from phenolsulphonic acid, naphthalene sulphonic acid and naphtholsulphonic acid, and (S') is a sulpho-group-containing, formaldehyde-based syntan (S).

25. A process according to claim 9, wherein (pre)tanned leather is retanned with an aldehyde-based syntan (S) or ($E_S$).

* * * * *